United States Patent [19]

Colautti

[11] 4,242,125

[45] Dec. 30, 1980

[54] CARBOTHERMIC PROCESS FOR PRODUCING SPONGE IRON AND THE IMPROVED VERTICAL RETORT SYSTEM USED IN SAID PROCESS

[75] Inventor: Franco Colautti, Ragosa di Povoletto, Italy

[73] Assignee: Kinglor Metor S.p.A., Buttrio, Italy

[21] Appl. No.: 961,689

[22] Filed: Nov. 17, 1978

[30] Foreign Application Priority Data

Nov. 22, 1977 [IT] Italy ..... 83525 A/77

[51] Int. Cl.[3] ..... C21B 13/02

[52] U.S. Cl. ..... 75/37; 75/91

[58] Field of Search ..... 75/37, 33-36, 75/38, 90 R, 91

[56] References Cited

U.S. PATENT DOCUMENTS 3,895,782 7/1975 Ugarte ..... 266/186

FOREIGN PATENT DOCUMENTS 2246156 3/1973 Fed. Rep. of Germany ..... 266/197

*Primary Examiner*—M. J. Andrews

*Attorney, Agent, or Firm*—A. W. Breiner

[57] ABSTRACT

Carbothermic process for reducing iron ore in an externally heated vertical retort characterized in that the charging mixture is pre-heated while descent within a first zone of the retort and with a substantially constant thermal charge; a second and progressive heating following the pre-heating in a second zone of the retort to initiate the carbothermic reaction and the first reduction phase of the charged mixture; the speed of descent within the second zone being progressively slower and the thermal charge being substantially constant; and a third and constant heating following the second and progressive heating in a third zone of the retort so as to complete the reduction process; the speed of descent within the third zone being substantially the same as the speed of descent in the second zone, the thermal charge being substantially constant, and maintaining the outside temperature of the second and third zones substantially constant in at least a part of the second zone and in all of the third zone, while maintaining the outside temperature of the retort at the second zone higher than the outside temperature of the retort at the third zone. Sponge iron and excess coal are withdrawn from a cooling zone of the retort after it has been cooled below the air oxidation temperature of the sponge iron, the withdrawal rate being controlled in order that the momentary speed of descent of the mixture within the retort is constant at every point in any one single horizontal section of the retort.

22 Claims, 2 Drawing Figures

Figures 1, 2:
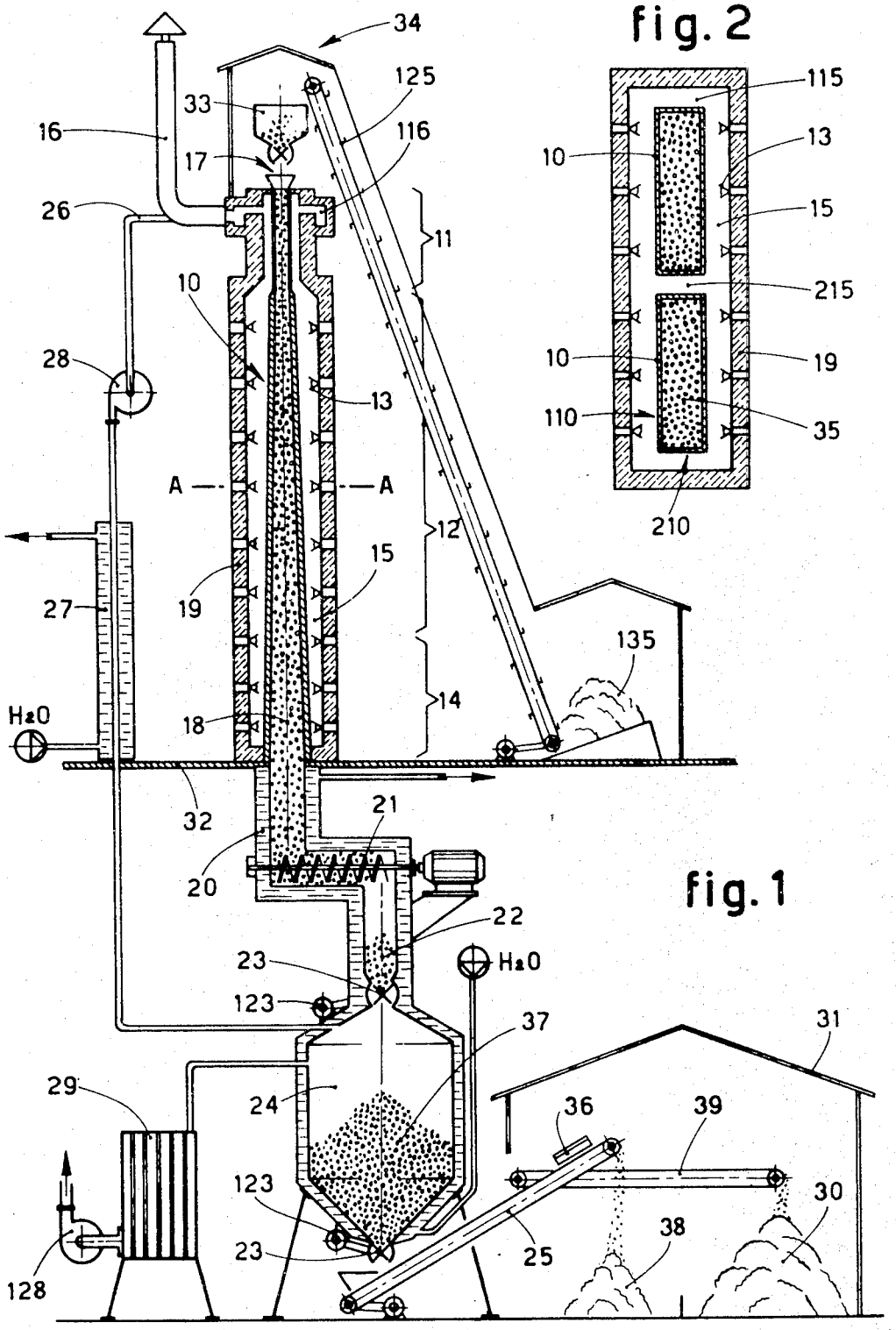

CARBOTHERMIC PROCESS FOR PRODUCING SPONGE IRON AND THE IMPROVED VERTICAL RETORT SYSTEM USED IN SAID PROCESS

The present invention is directed to improvements in the carbothermic process for producing sponge iron from iron ore, and to the system employing the improved process. More particularly, the invention is directed to an improved process wherein a mixture of ore and coal is introduced from above into an externally heated vertical retort furnace and from the bottom of the retort sponge iron together with ashes, coal dust and coal, after having been previously cooled, is withdrawn. The sponge iron is then separated magnetically from the impurities and from any coal which is still usable, the latter being recycled.

The production of sponge iron by direct reduction of the ore with coal is a process that has been known since ancient times. The known processes, however, involve notable shortcomings, and heretofore none of the known processes has been successfully used on an industrial scale. The shortcomings of the prior art processes include the long stay time of the ore in the retort, which may range from between 45 and 48 hours down to a minimum of between 30 and 36 hours;

the low productivity per cubic meter of retort;

the large consumption of energy in heating the retort externally;

the considerable wear on the retorts because of the presence of watery vapors and other corrosive processes;

the inability to treat determined ferrous ores such as the natural magnetites;

sintering of the produced sponge iron, and poor thermal efficiency.

All of the above and other unfavorable factors have made it impossible to operate on an industrial scale the methods known heretofore for carrying out reduction in externally heated vertical retorts.

It is, therefore, a primary objective of the present invention to make the known processes capable of use on an industrial scale. According to the improvements of the present invention it has been determined that insofar as possible the charged mixture of iron ore and coal as well as possible additives such as reducing gases, and/or desulphurizing agents are intimately mixed so as to improve the homogenizing of the reducing means together with the ore to be reduced. The batch or mixture should be, so far as possible, free of humidity or water moisture at the time it is introduced into the actual retort. The process of the present invention, therefore, includes a first pre-heating stage which is to dry the charged mixture fully, removing any volatile products, and eliminating any water in the mixture itself. When the batch or mixture has been charged, the mixture descends at a first speed which is initially constant or almost constant (drying phase), and thereafter descends at a second speed that is progressively and constantly reduced. The progressive reduction of speed conditions coincides substantially with the following three phases of the process:

(1) the mixture is brought to an appropriate temperature to start the reducing reaction;

(2) the stoichiometric reducing process is begun and in the case of haematite ($Fe_2O_3$) $Fe_3O_4$ is produced; and, thereafter, (3) FeO is produced.

Thereafter, the speed of descent of the mixture continues to lessen according to the preceding constant function and thereby coincides with the phase of the reduction of the ore from FeO to Fe. According to the invention each phase of the stoichiometric reduction process coincides with a different external heat treatment. This difference in external heat treatment serves to ensure an almost constant temperature in the external part of the retort by keeping the thermal charge almost or substantially constant.

It has also been found advantageous to use external burners for heating the retort, which burners have a frontal radiation bowl, which are themselves well known in another field of the art. It is possible, however, to employ the exhaust gases of the retort system to pre-heat the air used by the heating means. The use of the frontal radiation bowl, which is made incandescent by the flames, enables the heat of radiation to be recovered and thereby provides greater efficiency and greater uniformity of heating. According to the invention, external heating is obtained with sets of burners arranged in rings, whereby each ring lies at right angles to the vertical axis of the retort. These rings of burners enclose the retort throughout its whole heating height apart from the pre-heating zone, which is advantageously heated with the combustion gases of the retort system as heretofore noted. The burners can be regulated ring-by-ring, or else the regulation can be carried out on groups of rings. Each group of rings covers a well-defined vertical zone of the retort, and these zones each coincide substantially with a transitional phase in the stoichiometric reduction process. These rings normally heat only the long sides of the retort, and the short sides are heated advantageously with the combustion gases.

The improvements to the carbothermic process for reducing iron ore wherein an externally heated vertical retort is used and wherein a mixture of coal, ore to be reduced, and possible activating and/or desulphurizing agents is introduced from above, and wherein reducing gases can be injected at any desired height and whereby below the reduction zone there is a cooling zone including means for withdrawing sponge iron, excess coal, and ashes are characterized by providing in the retort in reciprocal cooperation and coordination a first upper pre-heating zone with a substantially constant section and wherein the speed of descent of the batch is maintained substantially constant;

a second heated zone and at least a third heated zone which begin immediately under the first pre-heat zone which have a progressively greater section which permits a progressively lower speed of descent of the batch;

heating means for reaching a maximum optimum temperature in the second zone, which temperature is maintained substantially constant in at least part of said second zone;

heating means for reaching a maximum optimum temperature in the third zone, which temperature is maintained substantially constant in the third zone, and a zone for cooling the sponge iron, whereby the first or pre-heat zone is heated with the combustion gases of the retort system and the second and third zones are heated with direct heating means.

More specifically, in accordance with the present invention, the piece size or granule size of the ore employed should be processed to have a diameter of from 5 to 25 mm., the best results being produced with an average granule size of from 15 to 20 mm. When coke is used in the process, its granule size should be kept between about 5 and 30 mm., the best results being obtained with a granule size of from 5 to 15 mm. The fines of the ore, namely dust and granules less than 5 to 6 mm. in diameter, should not be included loose in the batch mixture, but should be briquetted or pelletized. According to one modification of the present invention, a batch using briquettes or pellets already containing the ore, the reducing coal and possibly an activating and/or desulphurizing agent of a known type is used. In another modification, the briquettes or pellets can be mixed with any excess coal.

The batch is first dried in the pre-heating or first zone in the retort by bringing the batch up to a temperature of about 400° C. This pre-heating assures that there is no water vapor in the successive portions of the retort. The pre-heating zone is advantageously made of refractory steel.

The retorts of the present invention have a substantially rectangular section, two opposing sides being substantially parallel and equi-distant throughout the whole height of the retort; whereas the other two sides form substantially two large zones. As earlier stated, the zones coincide with well-defined phases or groups of phases in the reduction process. In the first or pre-heating zone, where the retort is heated externally with the combustion gases, the section is substantially constant. This section has a ratio of the long side to the short side of between about 5:1 and 9:1, and preferably from 6:1 to 7:1. This constant section coincides with a constant or almost constant speed of descent.

The optimum speed of descent in the different zones will vary, depending on the ore and type of reducing coal employed. For ore and coal possessing the average granule sizes above-indicated, the speed of descent in the pre-heating zone will be from 1.1 to 2.2 meters per hour. Particularly good results have been obtained with a speed of descent ranging from 1.3 to 1.5 meters per hour. The parameters which link the height of this zone to the speed of descent are structured so as to ensure a final temperature of the mixture at the end of the pre-heating zone at a level of about 400° C. with a thermal charge of about 15,000 to 25,000 Kcal/m$^2$h., said thermal charge being on an average about 20,000 Kcal/m$^2$h.

The second zone, or the zone following the pre-heat zone is where the iron ore is reduced from $Fe_2O_3$ to $Fe_3O_4$ to FeO and has, as above stated, a vertical section that becomes progressively greater as it goes downwards. The section at the exit from the second zone corresponds to an optimum average descent speed of from 0.80 to 0.90 meters per hour in the case of a mixture of the type above stated, where the average speed in the pre-heating zone is from about 1.3 to 1.5 meters per hour.

Heating by means of rings of burners is advantageously done only on the long sides, the short sides being lapped by the combustion gases. The rings of burners are distributed in such a way as to provide heat evenly according to the thermal requirements of the reduction process in its various reduction movements. The thermal charge is kept between 15,000 and 25,000 Kcal/m$^2$h and at an average of about 20,000 Kcal/m$^2$h. According to the present invention, the temperature of the mixture at the beginning of the second quarter of the second zone should have already reached about 850° C. to 900° C. so as to ensure the start-up of the reducing reaction. About halfway down the second zone, the optimum temperature is of the order of 1000° C. to 1030° C., with a maximum of 1050° C. Throughout the whole of the second zone the external temperature of the retort should be kept substantially constant between 1100° C. and 1300° C., with an optimum level of 1170° C. to 1230° C.

The third or lower reducing zone of the retort is characterized by a speed at its exit of about 0.50 to 0.55 meters per hour. As stated hereinbefore, the heating in this zone is also applied along the two long sides and the thermal charge varies between 15,000 Kcal/m$^2$h and 25,000 Kcal/m$^2$h, and has an average value of about 20,000 Kcal/m$^2$h. In the third zone the external heating serves only to maintain a homogeneous and optimum temperature within the mixture, said temperature being of the order of 1000° C. to 1030° C., with a maximum of 1050° C. In this zone the external temperature of the retort is kept substantially constant at between 1070° C. and 1250° C., the preferential temperature being from 1130° C. to 1200° C.

After leaving the third zone, the material passes into a first cooling zone, from which it is continuously withdrawn by a plurality of screw feeders, or the like, which deliver it into a first chamber for further cooling. The mixture then passes into a second chamber for its final cooling. The final cooling chamber contains a mixture of sponge iron and excess coal.

The following results were obtained in an industrial-scale plant when the ore used had an initial average content of 63/64% iron and 90/91% haematite $Fe_2O_3$. After a stay time in the retort of 11 to 12 hours (for pre-heating and reduction), the sponge produced had a total iron content, comprising metallic iron and FeO, amounting to 87/88% with a degree of metallization (i.e., proportion of metallic iron to total iron) of about 92%. This means that about 80% of the total iron content of the sponge was metallic iron. These results were obtained with the average speeds indicated hereinbefore, which yielded an output of about 55 to 65 kgs/m$^3$h. It is noted that the materials, and especially the coal, used in the above-stated run were not of the best quality. When briquettes or pellets are used, the results obtained are better and can be further improved with the addition of an agent to activate the reaction. The use of briquettes of a self-reducing type provides in addition the advantage of enabling their composition and also that of the batch to be adjusted. Moreover, the use of briquettes enables sponge iron to be produced which is substantially free of appreciable accompanying impurities.

According to the invention, the sponge iron is to be withdrawn in such a way as to ensure an even descent throughout any one horizontal section in the retort. This is necessary in that a descent which is not homogeneous entails stay times and, therefore, degrees of metallization varying from one zone to another, and also the risk of jamming or sintering.

The reducing or the second and third zones are proportioned in order that the third zone corresponds to from 27% to 33% of the whole height of the area heated with burners; or, in other words, the third zone is 27% to 33% of the total of the second and third zones.

According to the invention, the sponge iron leaving the withdrawal means is stored temporarily in a first chamber having a shut-off valve at its lower end. It is then delivered from said first chamber to a second chamber which is kept under an over-pressure so that, when the shut-off valve at the lower end of the first chamber opens, the CO present therein cannot escape. This over-pressure in the second chamber is obtained with inert gas which advantageously consists of gases withdrawn from the stack (at about 850° C. to 950° C.), cooled to the ambient temperature (about 20° C. to 40° C.), and introduced into the second chamber. These inert gases fulfill the purpose of preventing oxidization of the sponge iron. The excess of inert gas is caused to pass through impinging scrubber baffles and can then be reused by being introduced into the chamber surrounding the retort.

With reference to the aforesaid,

FIG. 1 in the drawing shows diagrammatically a plant which comprises the improvements of the present invention; and FIG. 2 is a cross-section along lines AA of the plant of FIG. 1.

In the drawing, 11 is the first or pre-heating zone and is heated with the combustion gases. 12 is the second zone and is heated externally by means of burners which have a radiation bowl 13. 14 is the third zone and is also heated externally with burners 13. 16 is the stack which receives the gases from the collecting ring 116 and may be of any desired type. 17 is the inlet mouth positioned at the top of the retort 10. 18 is the outlet from the retort 10. 19 is the structure that contains and bounds the chamber 15 and also serves as a support for the burners 13. 20 is the zone positioned below the outlet 18 and serves to cool the sponge iron, this cooling being obtained with forced circulation of water in an interspace. This cooling action also affects chambers 22 and 24. 21 are the withdrawal means and advantageously comprise a plurality of screw feeders which take the sponge iron from the zone 20 and deliver it to the chamber 22, which is the first chamber that contains the sponge iron. 23 are the butterfly valves which are operated by motor means 123 and are positioned at the bottom of the chambers 22 and 24. These butterfly valves serve to regulate the flow of the sponge iron from the chambers 22 and 24. 24 is the second chamber that contains the sponge iron and is connected to 22 in such a way as to realize an airtight seal against entry of the air from the outside. 25 is a conveyor belt to remove the sponge iron and excess coal.

26 is the intake that draws from the stack 16 the gases which, when cooled, serve to keep the chamber 24 under over-pressure, thus preventing the entry of atmospheric oxidizing gases. 27 is diagrammatically a circuit to cool the gases and envisages a heat exchanger which can be fed with water, as shown, or with air. 28 are means to blow the gases into the chamber 24, and 128 are means which draw the gases from the chamber 24 and make them pass through the baffles 29, thus enabling them to be reused. 29 are the scrubber and filtering baffles which serve to purify the gases coming from the chamber 24. 30 is the sponge iron which has been cooled and stored. 31 is a shed that shelters the sponge iron and excess coal from weathering action. 32 is the deck or supporting structure on which the structure 19 rests. 33 is the hopper containing the mixed batch and has a lower shut-off valve. Hopper 33 is fed by a conveyor belt 125 or other suitable means with the ore/coal mixture, which is thereafter introduced into the inlet mouth 17. 34 is a roof to shelter the hopper 33 and elevator 125 from bad weather. 35 is the ore/coal mixture during any reduction phase, whereas 135 is the starting mixture. 36 is a magnetic separator that serves to separate the sponge iron from the mixture 37 as composed at the end of the retort passing along the belt 25 and includes sponge iron and excess coal. 38 is the heap of excess coal which is recycled and reused to prepare the ore/coal mixture. 39 is the withdrawal conveyor belt which takes the sponge iron from the magnetic separator and deposits it on the heap 30.

Referring primarily to FIG. 2, 110 is the long sidewall of the retort 10. 115 is the space between the short wall 210 of the retort 10 and the corresponding short wall of the containing structure 19. 215 is the space between two neighboring short walls 210 of two retorts 10 positioned side by side. The retorts 10 may be one in number, or be placed side by side and be two or more in number. Again referring to FIG. 1, 116 is the upper ring that collects the combustion gases. 123 are motor means which are programmed to activate the shut-off valves 23.

The method of operation is as follows. When the valve of the hopper 33 is activated, the desired quantity of coal/ore mixture is introduced into the inlet mouth 17 of the retort 10. As the withdrawal screw feeders 21 are working, the mixture begins to descend at a constant speed and is progressively heated. When the mixture or charge reaches the end of the pre-heating zone 11, it has already reached a temperature of about 400° C. The pre-heating zone is subjected to a thermal charge of about 15,000 to 25,000 Kcal/m$^2$h.

In zones 12 and 14, the mixture descends at a progressively slower speed. The rings of burners 13 (section AA in FIG. 2 has been taken along a ring of burners) heat the outside of the retort so that there is one substantially constant temperature in zone 12 and another one in zone 14. In zone 12, the external temperature of the retort is kept between 1100° C. and 1300° C., whereas it is kept between 1070° C. and 1250° C. in zone 14. In zones 12 and 14 the thermal charge is between 15,000 and 25,000 Kcal/m$^2$h, and is kept at an average of about 20,000 Kcal/m$^2$h. At the outlet 18 of the retort the sponge iron is at a temperature between 1000° C. and 1050° C.

The screw feeders 21 can work continuously or intermittently. It is very important, however, that the working of the screw feeders is controlled so as to have no adverse effect on the even and regular descent of material in the retort in order to avoid any jamming or sintering. This descent of the material should be constant at any point in any one horizontal section of the retort at any height therein.

The sponge iron passes from the outlet 18 into the zone 20 where cooling action starts to that the sponge iron can be brought to a temperature such that when it is discharged into the atmosphere it does not have to undergo the oxidizing action of atmospheric gases. The sponge iron leaves the withdrawal zone and drops into the chamber 22. It next passes into chamber 24 through the butterfly valve 23. The chamber 24 is kept under over-pressure with the aid of the combustion gases previously cooled in 27. From the chamber 24 the combustion gases and the residual gases emitted by the sponge iron as it cools are drawn away by the exhaust fan after being filtered in 29. When the sponge iron has been cooled to a temperature at which the sponge iron does not undergo oxidization when in contact with the air, it is expelled from the chamber 24 through the valve 23 and is withdrawn by the conveyor 25.

There has been described improvements relative to the improved retort system and also the resulting reduction process. Some modifications, however, are possible. Thus, it is possible to control the speed of descent and keep the sections and/or heights unchanging. Moreover, all the sides of the retort can be heated. It is also possible to include in the batch some agents to activate the stoichiometric process of reduction or to provide some desulphurizing means or the like. It is possible to inject gaseous reducing agents at a temperature and at any height desired. It is possible to heat the pre-heating zone in a direct manner, the combustion gases being used to pre-heat the combustion air. These and other modifications are possible without departing from the scope of the present invention.

It is claimed:

1. A carbothermic process for reducing iron ore in an externally heated vertical retort which includes a reduction zone; means above the reduction zone for receiving a reaction mixture of coal and ore and a cooling zone below the reduction zone including means to withdraw sponge iron, excess coal and ashes from the vertical retort, comprising the steps of first pre-heating a reaction mixture of coal and ore, with a substantially constant thermal charge, said pre-heating being carried out with a constant speed of descent of the mixture within a first zone of said retort, said pre-heating of the mixture being carried out with the combustion gases generated by the carbothermic process; a second and progressive heating of said reaction mixture in a second zone of said retort following said pre-heating, said second and progressive heating being by means of external burners to initiate the reaction and first reduction of said mixture, the speed of descent of said mixture being controlled to become progressively slower and the thermal charge being substantially constant; a third and constant heating of said mixture in a third zone of said retort following said progressive heating, said constant heating being by means of external burners to maintain the heat in said third zone so as to complete the reduction process, the speed of descent of said mixture in said third zone being substantially the same as the speed of descent in the second zone, and the thermal charge being substantially constant; maintaining the outside temperature of said second and third zones of said retort substantially constant in at least part of the second zone and in the third zone while maintaining the outside temperature of said retort at the second zone higher than the outside temperature of said retort at the third zone; withdrawing the sponge iron from said cooling zone in order that the momentary speed of descent of said mixture within said retort is constant at every point in any one single horizontal section, and withdrawing the at least partially cooled sponge iron from the retort together with excess coal.

2. The improved process of claim 1 wherein the reaction mixture includes an activating agent.

3. The improved process of claim 1 wherein the reaction mixture includes a desulphurizing agent.

4. The improved process of claim 1 wherein a reducing gas is injected into the second or third zones during the reduction reaction.

5. The improved process of claim 1 wherein the reaction mixture is homogeneously mixed and wherein the components thereof have a minimum size no smaller than 5 mm., and the batch is free of fines or loose dust.

6. The improved process of claim 1 wherein the granule size of the ore in the reaction mixture is between 5 and 25 mm., and wherein the granule size of the coal is between 5 and 30 mm.

7. The improved process of claim 1 wherein the reaction mixture is pre-heated up to 400° C. in said first zone and the thermal charge of the pre-heating zone is constant at between 15,000 and 25,000 Kcal/m$^2$h.

8. The improved process of claim 1 wherein the heat in the second and third zones is obtained with external burners arranged in rings lying substantially on planes at right angles to the vertical axis of the retort and cooperating with at least two opposed faces of the retort, and wherein said rings of burners can be regulated at least by rings with at least one of said rings of burners being regulated independently in each zone of the reaction in the reduction process, and wherein the heating is controlled to maintain the temperature substantially uniform and constant in the section subtended thereby and the thermal charge in said zones is constant and is kept advantageously between 15,000 and 25,000 Kcal/m$^2$h.

9. The improved process of claim 1 wherein the outside temperature of the retort at the second zone is kept substantially constant between 1100° C. and 1300° C.

10. The improved process of claim 1 wherein the outside temperature of the retort at the third zone is kept substantially constant between 1070° C. and 1250° C.

11. The improved process of claim 1 wherein the said burners comprise a radiation bowl.

12. The improved process of claim 1 wherein the third zone corresponds to from 27% to 33% of the total height of the second and third zones.

13. The improved process of claim 1 wherein the substantially constant progression of the increase of the section of the second and third zones causes the stay times to coincide with the reaction times of the reduction process.

14. The improved process of claim 1 wherein the product is withdrawn from the third zone at between 0.40 and 0.80 meters per hour.

15. The improved process of claim 1 wherein the product is withdrawn from the third zone at about 0.50 to 0.55 meters per hour.

16. The improved process of claim 1 wherein the maximum reduction temperature during the process is about 1050° C.

17. The improved process of claim 1 wherein the withdrawal of sponge iron from the lower part of the reduction retort is controlled to maintain an almost constant speed of descent within any one horizontal plane thereabove.

18. The improved process of claim 1 wherein the product of the third zone is partially cooled and then delivered into a first chamber and then into a second chamber which is kept under over-pressure with inert gas.

19. The improved process of claim 18 wherein the said first and second chambers are cooled.

20. The improved process of claim 18 wherein the second chamber is kept under over-pressure by combustion gases withdrawn from the retort and cooled to the ambient temperature.

21. The improved process of claim 20 wherein the inert gases are withdrawn from the second chamber, filtered, scrubbed, and then reused.

22. The improved process of claim 18 wherein the mixture of sponge iron and excess coal withdrawn from the second chamber is separated into its components and the excess coal is reused.

* * * * *